US006343440B1

(12) United States Patent
Ayers

(10) Patent No.: US 6,343,440 B1
(45) Date of Patent: Feb. 5, 2002

(54) ANTENNA TOWERS HAVING A NATURAL APPEARANCE

(76) Inventor: Rienk Ayers, 3130 Sky Way Dr., Santa Maria, CA (US) 93455

( * ) Notice: Subject to any disclaimer, the term of this patent is extended or adjusted under 35 U.S.C. 154(b) by 0 days.

(21) Appl. No.: 09/226,152

(22) Filed: Jan. 7, 1999

(51) Int. Cl.[7] ..... E04H 12/00

(52) U.S. Cl. ..... 52/40; 52/736.2; 52/736.3; 52/651.07

(58) Field of Search ..... 52/40, 736.2, 736.3, 52/651.02, 651.07, 726.4, 721.4, 738.1, 736.4; 428/18

(56) References Cited

U.S. PATENT DOCUMENTS 3,144,375 A * 8/1964 Turnage et al. ..... 428/18
4,855,167 A 8/1989 Biehl
5,085,900 A 2/1992 Hamlett
5,104,467 A 4/1992 Johnson
5,212,912 A * 5/1993 Foissac ..... 52/40
5,533,304 A * 7/1996 Noble ..... 52/40
5,611,176 A 3/1997 Juengert et al.
5,787,649 A 8/1998 Popowcyh et al.
5,787,673 A * 8/1998 Noble ..... 52/726.1
6,099,920 A * 8/2000 Kao ..... 428/18

* cited by examiner

*Primary Examiner*—Carl D. Friedman
*Assistant Examiner*—Jennifer I. Thissell
(74) *Attorney, Agent, or Firm*—Roland H. Shubert

(57) ABSTRACT

A monopole tower with antennas mounted near the top thereof is configured as either a tree such as a palm, or a pine, or other variety of tree having foliage that emulates that of natural trees so that the tower blends inconspicuously into the local surroundings. In the palm tree embodiment, one or more frond mounting assemblies encircle the monopole tree trunk, and include a plurality of receivers for holding palm fronds that are oriented at different angles relative to the monopole trunk. Individual fronds are made up of frond leaflets that are positioned along a frond spine member to closely emulate the appearance of a natural palm frond.

7 Claims, 9 Drawing Sheets

ANTENNA TOWERS HAVING A NATURAL APPEARANCE

BACKGROUND OF THE INVENTION

1. Technical Field

This application relates to a tower that is configured as a tree or other plant species, and is arranged for the mounting and support of antennas thereon. The tower and antennas are arranged in a manner to intentionally obscure the visual appearance of the antennas to a ground level viewer.

2. Background Art

Cellular telephone technology requires that a user be within line of sight distance of an antenna that sends and receives signals to and from the user's telephone. It is routine practice to maximize the geographical area, or cell, served by each antenna by installing the antenna at an optimum height. In urban areas, antenna sites were often available on existing tall structures such as buildings or existing antenna towers. As the area covered by cellular telephone systems has expanded into suburban and rural areas, it has become necessary for cellular communications companies to erect increasing numbers of antenna towers.

New antenna installations typically employ a monopole antenna that consists of an upstanding post some 40 to 125 feet in height. One or more antenna sets are mounted near the top of the post. The stark appearance of such monopole antennas frequently generates intense local opposition to any antenna site that might be proposed. Much of the local opposition to proposed monopole antenna sites can often be blunted if the antenna structure is camouflaged so as to give the visual appearance of a tree. Such camouflaged antenna structures must not interfere with signal transmission or reception, must withstand the extremes of local weather, and must blend inconspicuously into the local setting.

Antenna support structures in the form of a tree are described in U.S. Pat. Nos. 5,611,176 and 5,787,649. The first patent, U.S. Pat. No. 5,611,176 to Juengert et al, describes an antenna support structure in the form of a white pine tree. The tree trunk portion of the antenna structure consists of a hollow metal post having antenna assemblies mounted thereupon adjacent the top end. Limbs, branches and foliage situated below the antenna assemblies largely hide the antennas from view. A layer of epoxy that is textured and colored to mimic pine bark covers the post exterior.

The second patent, U.S. Pat. No. 5,787,649 to Popowych et al, describes a monopole antenna tower that simulates a tree, and is capped by electronic antennae and equipment. A tapered steel post of polygonal cross section simulates a tree trunk, and foliage components that simulate either a palm tree or a pine tree are secured thereto. The lower portion of the monopole palm tree trunk is covered by fiberglass cast as half tubes within a mold to simulate natural palm bark. Polyurethane, also cast to simulate natural tree bark, covers the upper portion of the monopole trunk. Branches and boughs that simulate tree foliage are attached to the monopole trunk by way of tubular pipe stubs or receptors that are welded to the monopole trunk. A male branch member is inserted into the tubular receptor, and is secured therein by a fastener such as a bolt.

While the antenna support structures of the prior art are functional for their intended purpose, they are expensive to construct and lack the emulation of natural foliage that is desired for the antenna towers to blend inconspicuously into the local surroundings. This invention fills that need.

Hence, it is an object of this invention to provide an antenna tower that has a natural tree plant-like appearance.

It is another object of this invention to provide a means for mounting foliage and antennas to the trunk of a tree-like antenna tower.

Yet another object of this invention is to provide a system for mounting antennas on a pine tree antenna tower in a way that the antennas are minimally obstructed by foliage, but arranged to be visually unobtrusive.

Another object of this invention is to provide more natural looking fronds for a palm tree antenna tower, and a method for making those fronds.

A further object of this invention is to provide an antenna tower that is formed as a saguaro cactus.

SUMMARY OF THE INVENTION

This invention provides a tree plant-like antenna tower that can be formed either as a palm, tree or a pine, or other tree species, or as a saguaro cactus. The tree plant trunk or stem is formed from a tapered or constant diameter metal, concrete or fiber reinforced composite pole clad with a polymeric composition to mimic the appearance of a the natural tree plant. In the palm tree embodiment, a bracket assembly holding a plurality of individual fronds is bolted to the pipe, and a second bracket assembly holding antenna mounting assemblies that allow the antennas to be fully rotatable. Artificial palm fronds are fabricated using a fiberglass rod core with leaflets mounted thereon. The leaflets may be oriented progressively from a horizontal attitude at the frond base to a vertical attitude at the frond tip to more accurately represent the frond structure of a real palm tree.

DETAILED DESCRIPTION OF THE INVENTION

Figure 1:
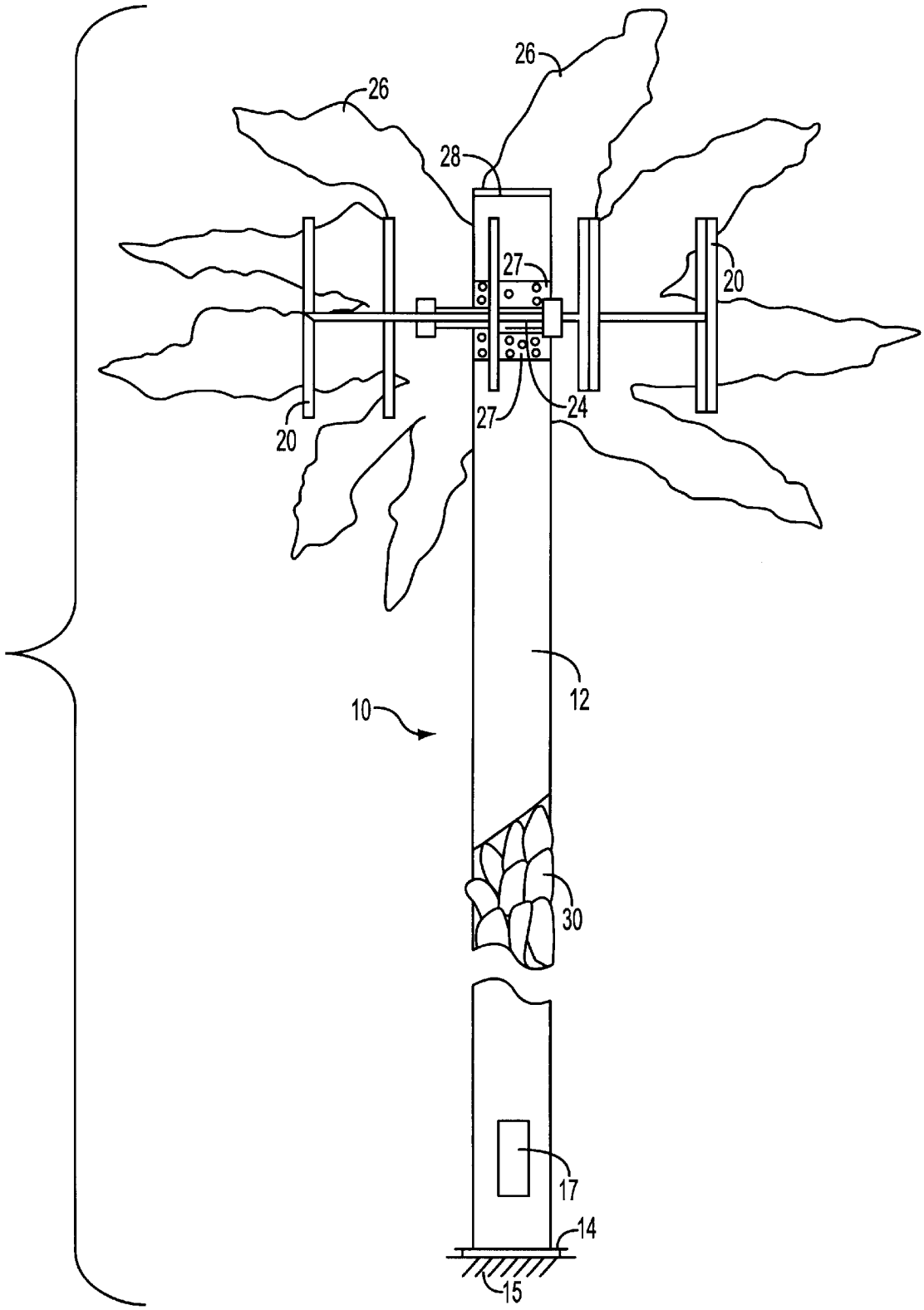
FIG. 1 is an illustration of an antenna structure according to this invention formed as a palm tree.
Figure 2:
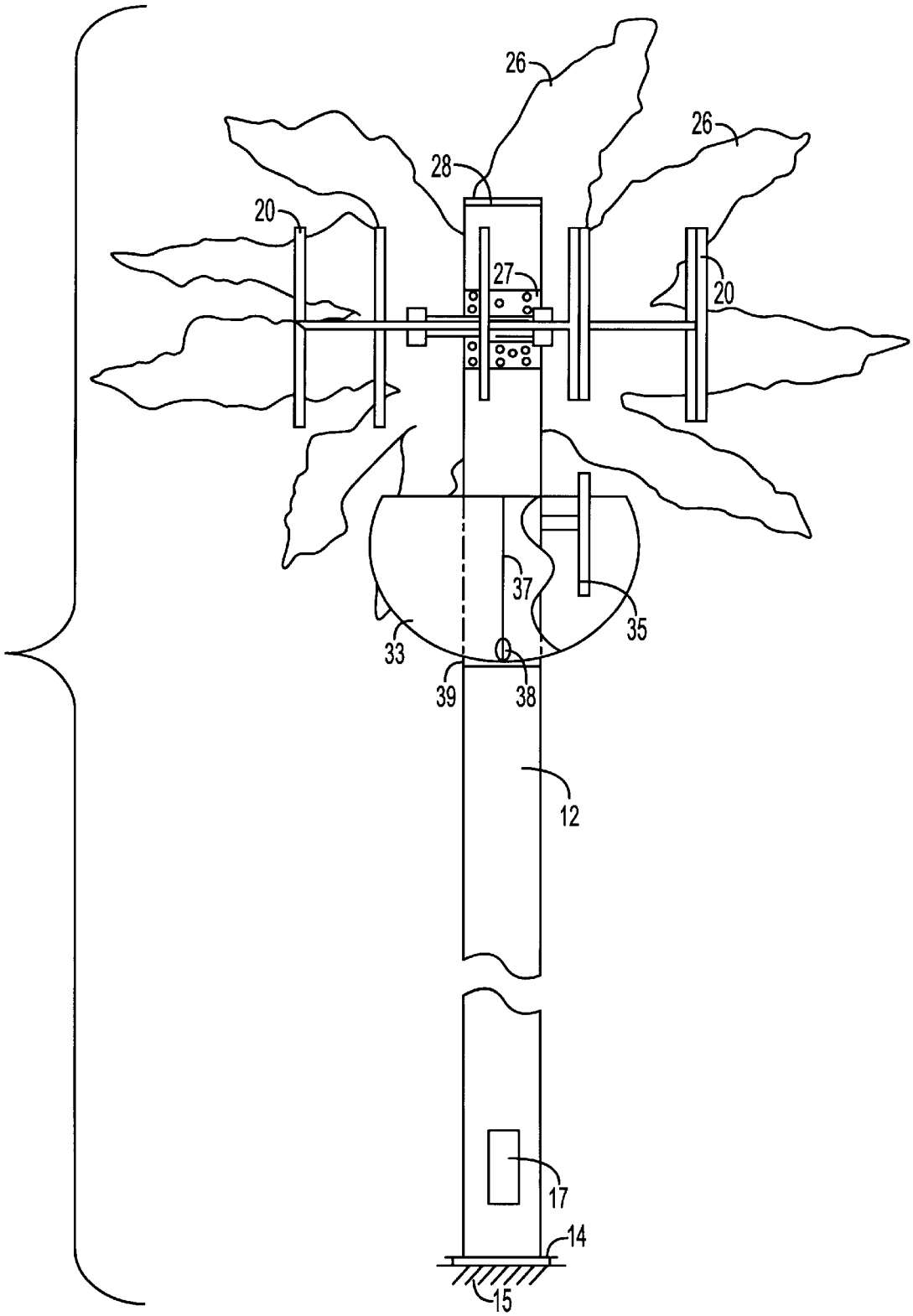
FIG. 2 is an alternative embodiment of the antenna structure depicted in FIG. 1, adapted to accommodate a second set of antennas that are mounted within a simulated growth pod.

A first embodiment of this invention in which the antenna tower is formed as a simulated palm tree is illustrated in FIGS. 1 and 2. The tower structure is shown generally at 10, with a tubular pole 12 serving as the trunk of the palm tree. Pole 12 may be fabricated from metal, concrete, or a fiber reinforced composite, commonly referred to as FRC. By way of illustration, pole 12 may suitably comprise a tubular steel pipe having a diameter of eighteen to twenty four inches with a wall thickness ranging from three-sixteenths to one-half inch. The overall height of the tree antenna tower 10 may range from about forty to more than two hundred feet.

The lower end of pole 12 is secured fixed to a support so that the pole is held in a secure upright position. That may be done, for example, by burying the lower end of the pole in the ground or by welding the pole end to a butt plate 14 which, in turn, is fixed to a foundation 15 that suitably may be a concrete monolith. Ports 17 are provided near the bottom of pole 12 to allow entry of communications cables that pass through the interior of pole 12 and connect to antennas 20 which are mounted on the pole near the top thereof. Antennas 20 are attached to pole 12 by means of an antenna bracket sub-assembly 24 that is shown in more detail in FIG. 6. A plurality of palm fronds 26, suitably on the order of sixty, are attached to pole 12 adjacent to antennas 20 by means of frond bracket sub-assemblies 27 which are shown in more detail in FIGS. 4 and 5. The top of pole 12 is closed by a weatherproof cap 28 to protect the wiring and other electronic components that are located within the pole. Also, the exterior of pole 12 is clad by a layer of molded and colored urethane or other suitable polymer to simulate the texture and appearance of a real tree trunk.

The realistic appearance of the cladding that forms the surface of the tree plant trunks, and of the tree branches as well, is obtained first by forming a mold from tree plant parts, either bark or branch, of the pine, or palm, or other plant species tree that is being emulated. Segments of branches or bark are then cast in the mold from a polymeric material such as polyurethane. The surface of the simulated tree plant part is colored to match the local foliage. Coloring is preferably accomplished in a two step fashion. A pigment or other coloring agent is added to the polymeric material used to make the casting to obtain the base coloration of the tree part. Then, darker highlights are added by painting accent areas to more closely match the coloration of the natural tree part.

FIG. 2 illustrates another embodiment of the palm tree antenna tower shown in FIG. 1. In this embodiment a pod structure 33 that mimics the new growth pod, or pineapple, found on palm trees is mounted underneath the frond brackets 27. Pod structure 33, shown in partial break away view, is arranged for the deployment of a set of antennas 35 therein. That set of antennas may be the only antennas carried by the tree tower, or it may be a second set of antennas together with associated hardware. Pod structure 33 preferably is of a generally hemispherical shape, open at the top, and is molded of a fiber reinforce composite or other material that is essentially transparent to electromagnetic radiation. It is preferred that pod 33 be molded in either two or three segments that connect along joints 37. One or more drain ports 38 are provided at the bottom of pod 33 to prevent rain water from collecting therein. The pod segments are secured to pole 12 by means of clamp means 39 at the lower margin of pod 33.

Figure 4:
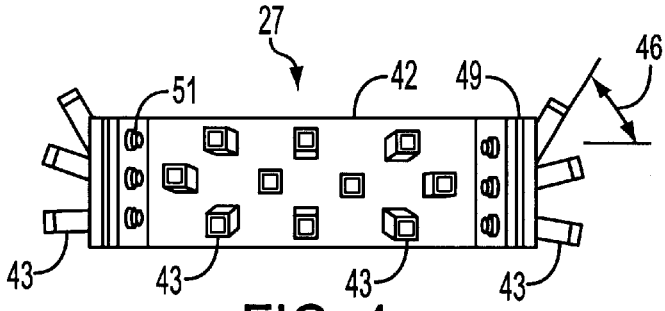
FIG. 4 is a side view of a bracket sub-assembly arranged to securely hold a plurality of palm fronds.
Figure 5:
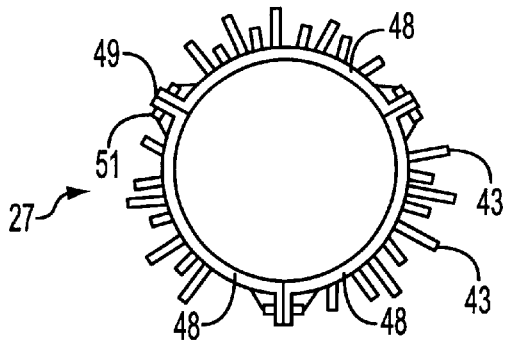
FIG. 5 is a plan view of the bracket sub-assembly of FIG. 4.

Details of frond bracket sub-assembly 27 are shown in FIGS. 4 and 5. Bracket 27, shown in side view in FIG. 4, comprises a metal collar 42 that fits around and clamps to pipe 12. A number of receiver fixtures 43 are fixed to collar 42 by welding or other suitable means. In a preferred embodiment, fixtures 43 comprise short lengths of square pipe oriented at various angles 46 to the horizontal. Angle 46 may range from about 90° above the horizontal to about 30° below the horizontal. Collar 42 is preferably formed in segments 48, suitably three, that are fastened together at junctures 49 by means of bolts 51 to tightly clamp around the exterior of pipe 12. The vertical height of collar 42 may conveniently range from about six to twelve inches, and each collar segment 48 may have attached thereto as many as ten or more fixtures 43 to hold an equal number of fronds 26.

Figure 6:
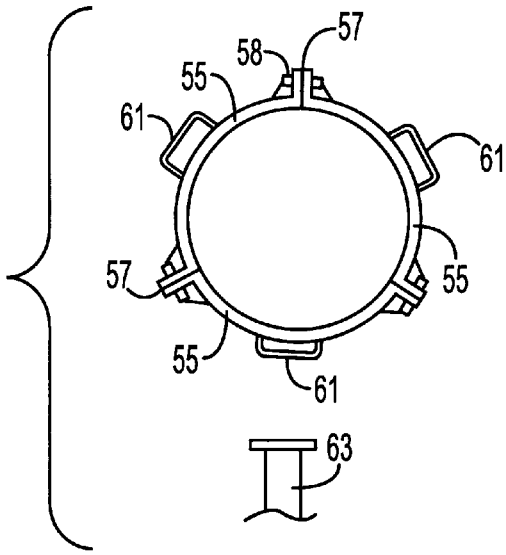
FIG. 6 is a plan view of a second bracket sub-assembly for the mounting of antennas to the antenna tower.

It is preferred to mount a pair of brackets 27 on pole 12, one directly above, and one directly below the antenna bracket sub-assembly 24 that is shown in FIG. 6. Like frond holding brackets 27, the antenna bracket 24 comprises a collar that is made up of multiple segments 55 that are fastened together at junctures 57 by means of bolts 58. Each bracket segment 55 is provided with an antenna mount 61 to which is attached an antenna arm member 63. Bracket 24 is freely rotatable about pole 12 so as to allow convenient angular orientation of the antenna structure.

Figure 7:
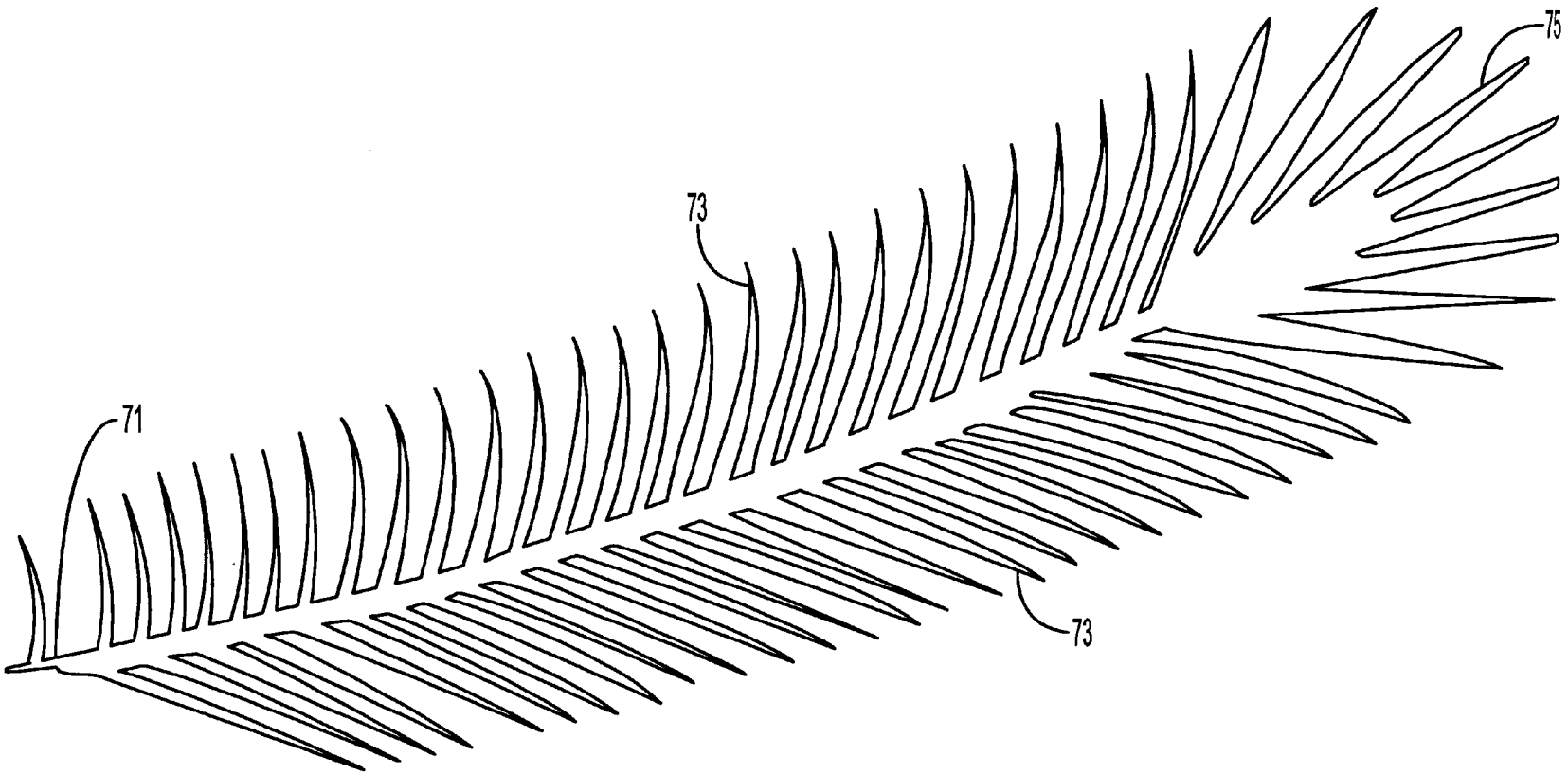
FIG. 7 is an illustration of a palm frond that forms the foliage of the tree antenna structure of FIG. 1.
Figure 11:
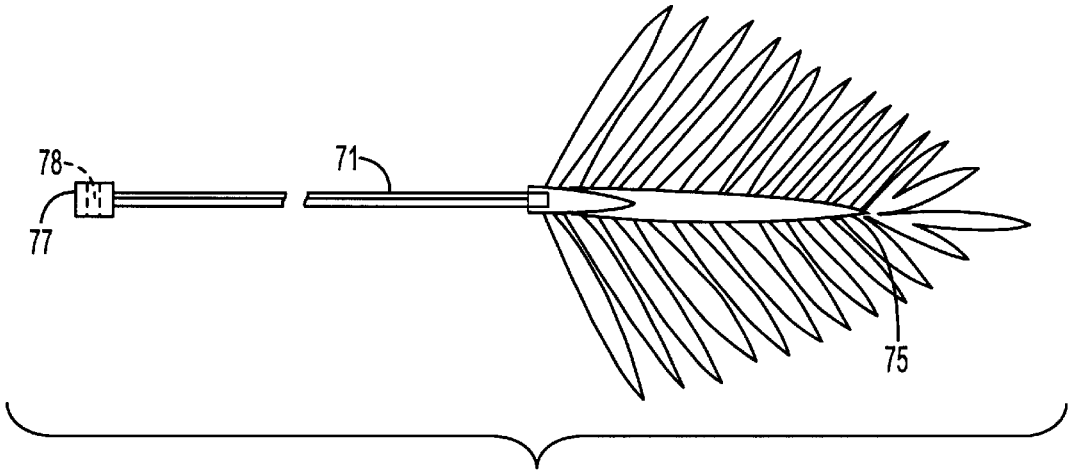
FIG. 11 is an illustration of a frond tip that makes up the terminus of the palm frond depicted in FIG. 7.

FIG. 7 illustrates an artificial palm frond that is fabricated according to this invention. It is constructed of a material, preferably a thermoplastic such as polystyrene or polyvinyl chloride, that does not interfere with the radio signals that are transmitted to and from the antennas. The frond includes a flexible rod core 71 that is suitably fabricated from a glass fiber reinforced resin. Rod core 71 is preferably of uniform polygonal cross section, has a plurality of frond leaflets 73 mounted thereon, and terminates at a frond tip 75 which is adhesively secured to an end of rod core 71. The stem end of rod core 71, opposite to the frond tip, terminates in a round or polygonal (shown here as square) metal tube member 77 (FIG. 11) that snugly fits into any one of fixtures 43. Tube member 77 is secured within a fixture 43 using adhesives, or preferably by means of a pin inserted through holes provided in the side walls of fixture 43 and through bore 78 of tube 77.

Figure 9:
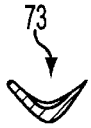
FIG. 9 is a sectional view of the frond leaflet of FIG. 8 taken along lines 9—9 of FIG. 8.
Figure 8:
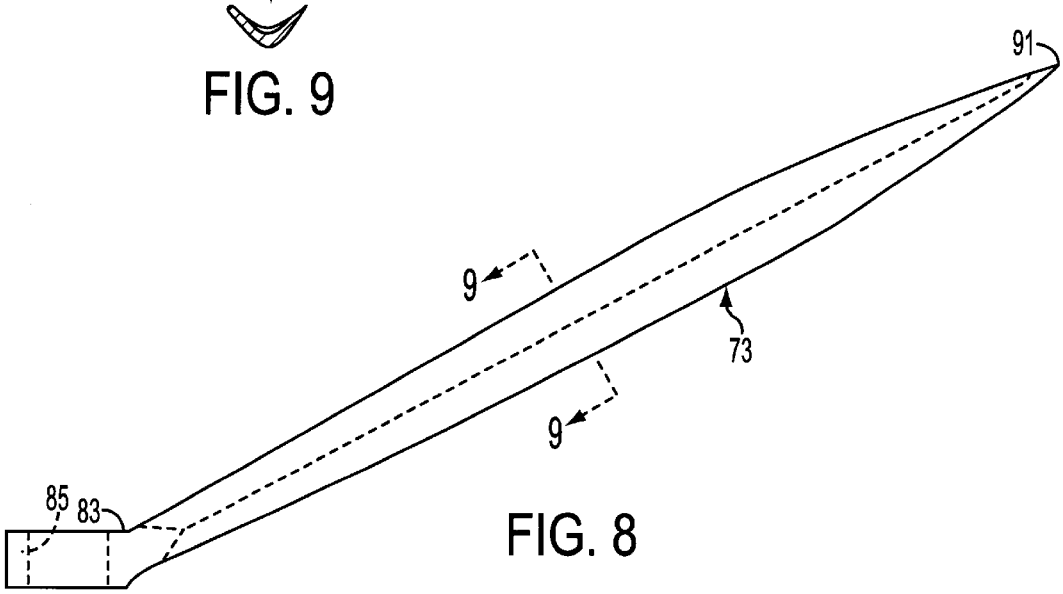
FIG. 8 is a side view of a frond leaflet that makes up a part of the frond illustrated in FIG. 7.
Figure 10:
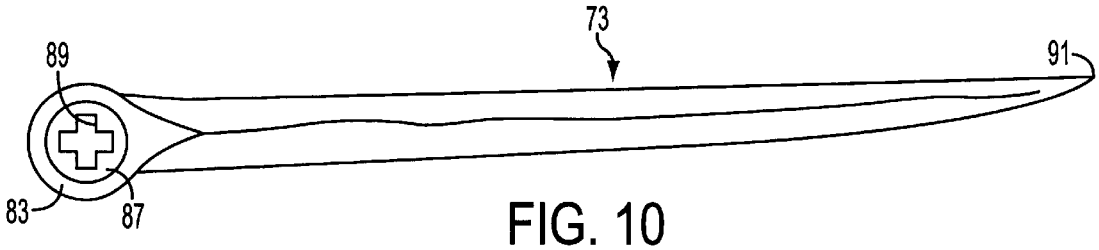
FIG. 10 is a plan view of the frond leaflet of FIG. 8.
Figure 12:
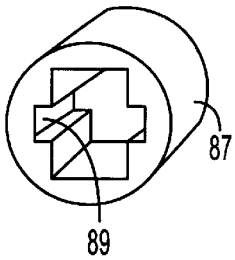
FIG. 12 is an oblique view of a shaft insert that allows orientation of individual frond leaflets.

As is best shown in FIGS. 8 and 10, individual frond leaflets 73 have a pointed tip end 81 and a wider, flattened basal end 83. The frond leaflets 73 preferably display a generally triangular or shallow V-shape in cross section as is shown in FIG. 9. A hole 85 through basal end 83 is oriented perpendicular to the flattened sides of end 83. It is preferred that hole 85 be circular to accommodate a generally cylindrical insert 87 that is shown in perspective view in FIG. 12. A bore 89 that generally conforms in size and shape to the polygonal cross section of rod 71 is formed through insert 87. The axis of bore 89 is parallel to, and preferably is aligned with, the cylindrical axis of hole 85.

Figure 13:
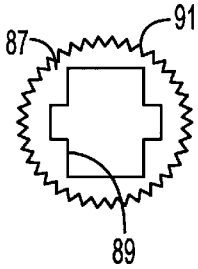
FIG. 13 illustrates another embodiment of the shaft insert of FIG. 12.

Individual leaflets are mounted upon rod core 71 in an alternating fashion, left and right, by threading core 71 through the bores 89 of the individual leaflets. The polygonal shape of rod core 71 and conforming bores 89 hold and maintain each frond leaflet in a set orientation. Natural palm fronds display a regularly changing orientation of the frond leaflets. Individual leaflets are oriented generally horizontally at the frond stem end near the trunk, and gradually progress to an approximate vertical orientation at the frond tip. The provision of the cylindrical insert 87 in the basal end of each frond leaflet 73 allows the orientation of each frond leaflet to be incrementally changed simply by angularly adjusting the position of insert 87 within hole 85. Insert 87 is then fixed at the desired angular position within hole 85 by gluing the insert into place. Alternatively, insert 87 and hole 85 can be dimensioned such that the insert forms a tight, press fit within the hole. A progressive adjustment of the angular position of the insert may also be accomplished by providing the outer cylindrical surface of insert 85 with small, uniform notches or serrations 91 as is illustrated in FIG. 13. corresponding serrations would then be provided on the inner surface of basal end hole 85.

Figure 14:
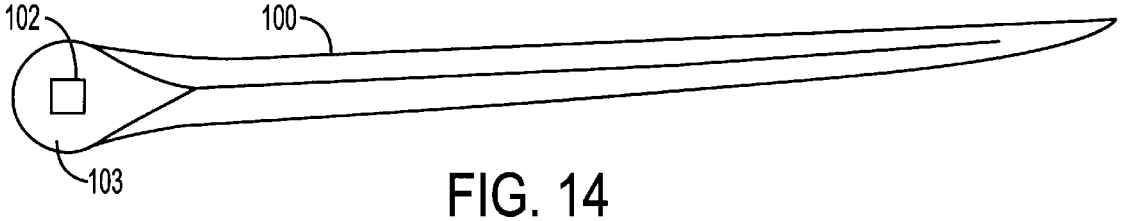
FIG. 14 is a plan view of another embodiment of a frond leaflet making up a part of the frond illustrated in FIG. 7.

Another embodiment of the palm leaflets is illustrated in FIG. 14. The leaflets 100 of this embodiment are generally similar in size and shape to the leaflets illustrated in FIGS. 8 and 10. They differ, however, in an insert (element 87) is not used, and the hole or bore 102 at frond leaflet end 103 is sized and shaped to conform to the polygonal cross section of rod 71. As before, individual frond leaflets 100 are mounted upon rod core 71 in an alternating fashion, left and right, by threading core 71 through the bores 102 of the individual leaflets. This embodiment does not allow for the progressive change in the orientation of individual frond leaflets from the stem end of the frond to its tip.

Figure 3:
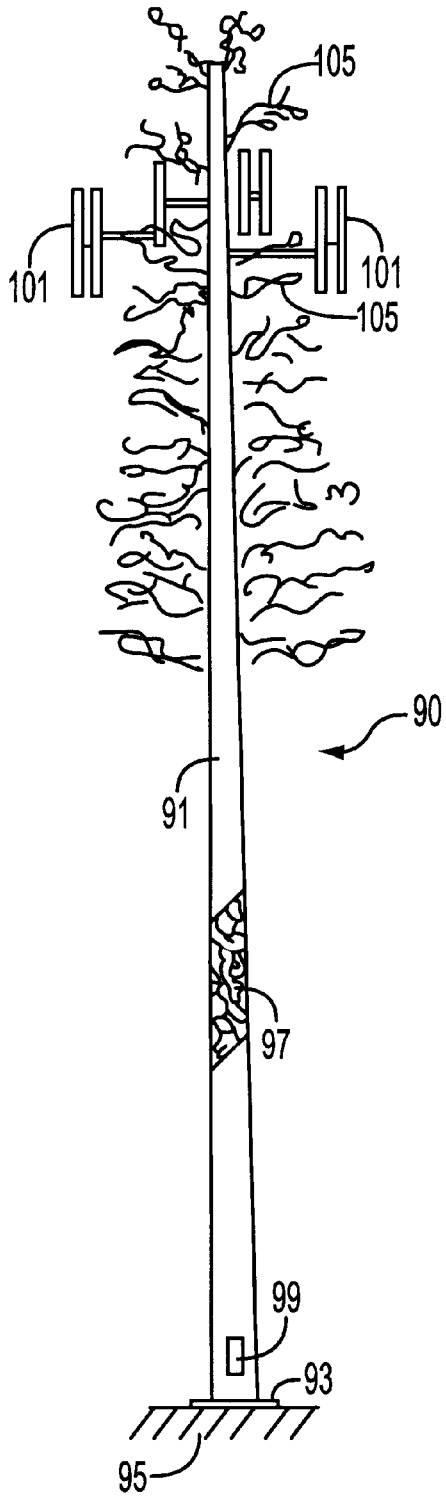
FIG. 3 is an illustration of an antenna structure according to this invention formed as a pine tree.

Turning now to FIG. 3, there is illustrated another embodiment of this invention in which the antenna tower is formed as a pine tree 90. This antenna tower preferably uses a pole 91 having a regular or step taper, decreasing in diameter from bottom to top, to more closely mirror the natural taper of a pine tree trunk. As with the embodiment of FIG. 1, the bottom of pole 91 is secured to a butt plate 93 which, in turn is fixed to a foundation 95. A layer of colored polymeric material, such as polyurethane, is molded from an actual tree and is glued to the exterior surface of pole 91 to give the appearance of a real tree trunk. Ports 99 are provided near the bottom of pole 91 to allow entry of communications cables that pass through the interior of pole 91 and connect to antennas 101 which are mounted on the pole near the top thereof. Antennas 101 are attached to pole 91 by means of the antenna bracket sub-assembly 24 that is detailed in FIG. 6. It is preferred that antennas 101 be placed to extend outward from the tree trunk pole 91 a distance at least as great as is the length of those tree branches 105 which are located in the proximity of, both above and below, antennas 102. So long as there is foliage between the antenna and pole 91 there is created enough visual distraction to render the antennas unobtrusive to the casual viewer. The installation can be made even less noticeable by painting the antenna elements in a camouflage pattern of browns and greens.

Figure 15:
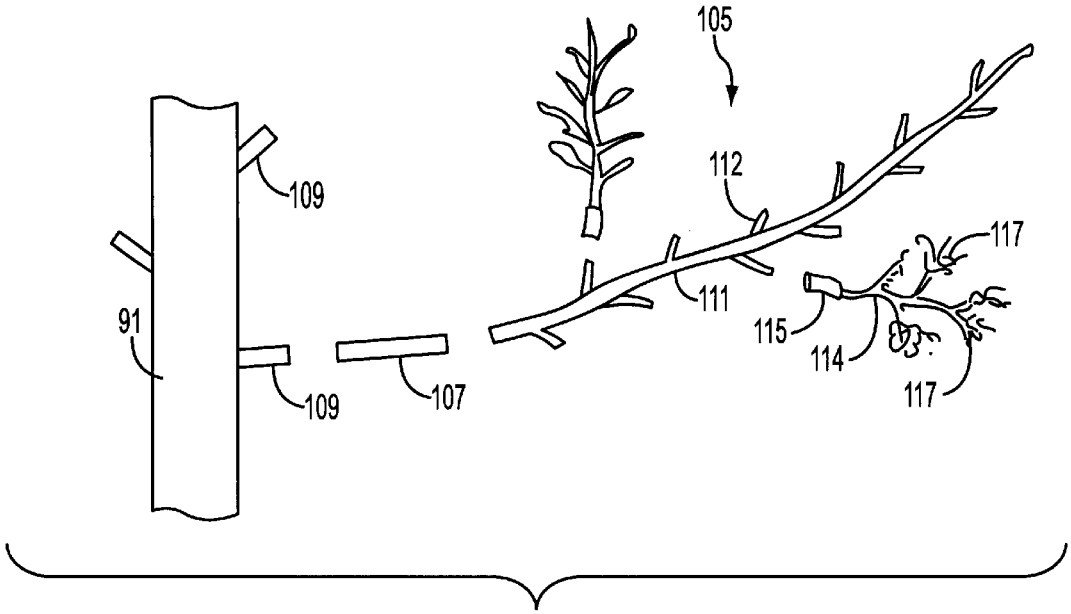
FIG. 15 is a break away view of foliage suitable for use with the embodiment of FIG. 3, as well as the manner in which the foliage is mounted.

FIG. 15 shows in a break away view of the tree branches that are attached to the trunk pole 91. The artificial branches 105 comprise a basal tube mount 107 that serves as a junction between a receiver stub bracket 109, similar to fixture 43 shown in more detail in FIG. 16, and a branch spine 111. Branch spine 111 is fabricated from a structural plastic, such as a glass fiber reinforced resin, by forming a split mold using as a pattern an actual tree branch trimmed of foliage, and with the side branches cut to short stubs 112. In like fashion, side branches 114 are cast separately and are later attached to a stub branch 112 by means of connectors 115. Artificial foliage 117, similar to that used in artificial Christmas trees except made with plastic windings rather than metal, are then attached to the side branches 114. The resulting tree antenna tower is remarkably unobtrusive, particularly in locales having natural pine trees in relatively close proximity. As with the embodiment of FIG. 1, the materials from which the limbs, branches and foliage have been fabricated are selected so as not to interfere with the transmission of radio signals to and from the antennas.

Figure 16:
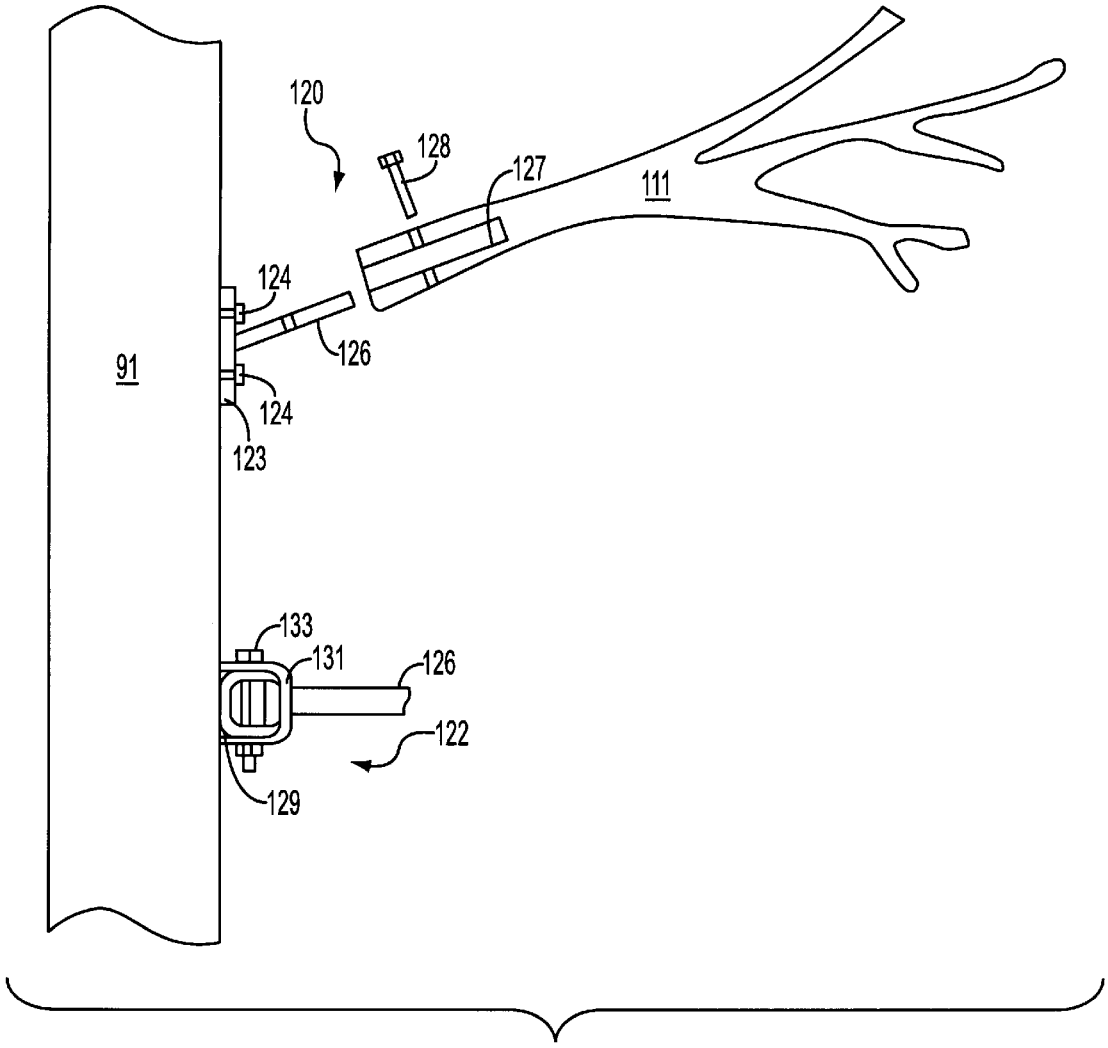
FIG. 16 is a detail view of the foliage mounting means of FIG. 15.

Referring now to FIG. 16, there is shown two different bracket means 120, 122 for attaching foliage branches to a main tree trunk pole 91. Bracket means 120 includes a plate 123 that may be attached to trunk 91 by means of studs 124 which pass through plate 123 and are threaded into tapped holes in the wall of pole 91. A rod member 126 extends outwardly from plate 123 to connect with and support a tree branch 111. Tree branch spine 111 may connect to rod 126 using sleeve 107, as is shown in FIG. 15 or, if branch 111 is large enough, may be inserted into a hole 127 that is provided at the basal end of branch spine 111 as is illustrated. The branch 111 is secured to rod 126 by means of a pin or bolt which passes through holes that are provided in both the pin and branch.

Bracket means 122 comprises a box member 129 that is attached to trunk 91, suitably by welding. A C-shaped channel fixture 131 is sized to fit over box 129, and is attached thereto by means of a bolt or pin member 133 which passes through holes provided in box 129 and channel. 131. As in bracket 120, a rod member 127 extends outwardly from channel 131, and is arranged for connection to a tree branch in the manner previously described. The angle to the horizontal made by rod 127 may be varied to conform to the branch pattern displayed by the tree species that is being emulated.

Figure 17:
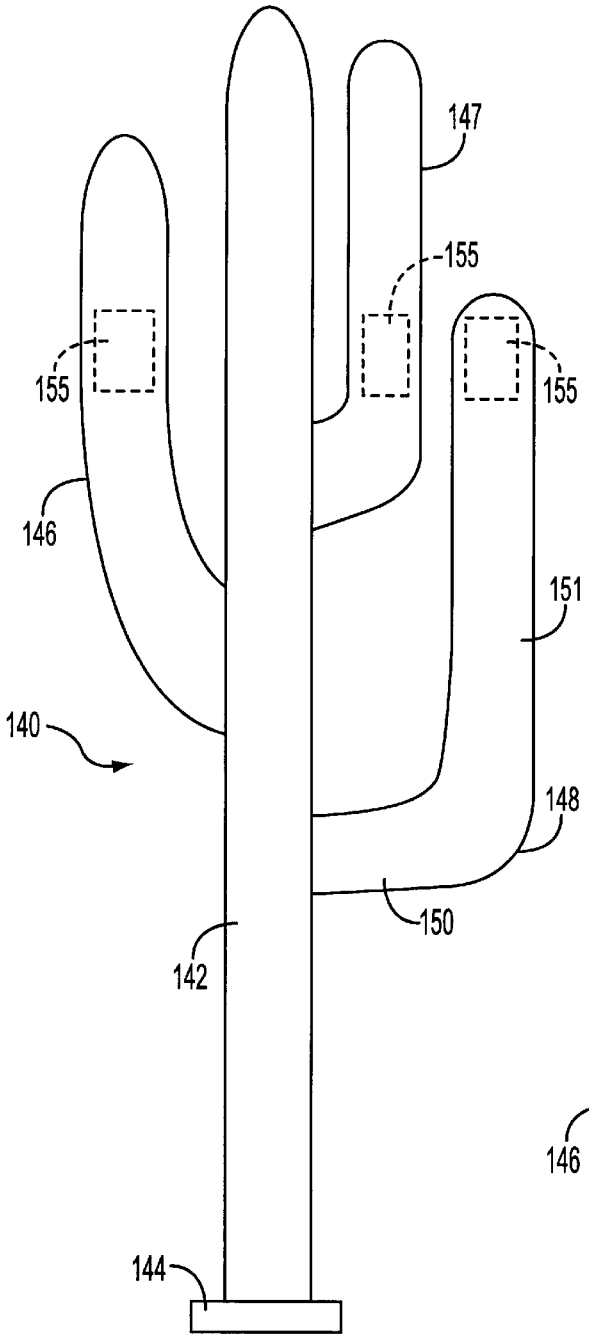
FIG. 17 is an illustration of an antenna structure according to this invention formed as a saguaro cactus.
Figure 18:
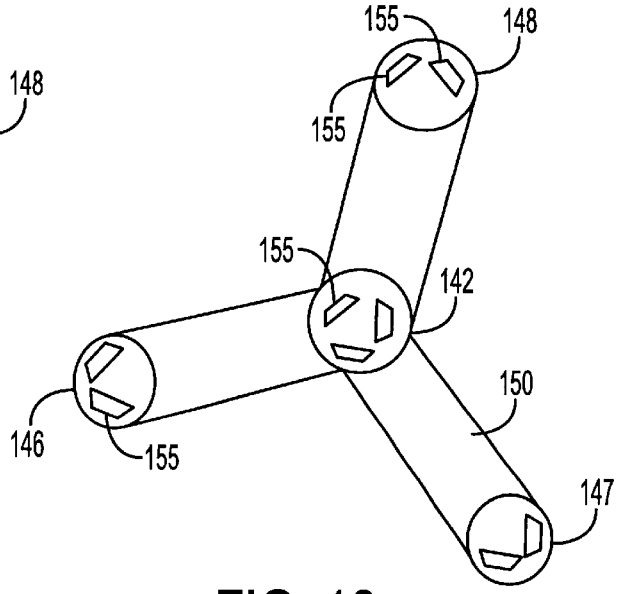
FIG. 18 is a plan view of the antenna structure of FIG. 17.

Referring now to FIGS. 17 and 18, there is shown another embodiment of this invention in which an antenna tower 140 is structured in the form of a saguaro cactus. The saguaro cactus is native to the Sonoran desert area of the American southwest, and grows in nature to heights of 50 feet or more. In this embodiment, the main trunk or stem 142 comprises a pole of generally uniform diameter that is fabricated from metal, concrete, or a fiber reinforced composite. The lower end of stem 142 is attached to a plate 144 or other suitable mounting means to position the tower in a stable, upright position. The exterior of stem 142 is clad with a layer of molded and colored urethane or other suitable polymer to simulate the surface of an actual saguaro cactus. The exterior cladding is obtained by forming a mold from the surface of an actual cactus and making a casting in that mold from a polymeric material such as polyurethane.

A plurality of branches, preferably three, extend from stem 142. Those branches, 146, 147, and 148, are positioned at the mid to upper level of stem 142. As is shown best by branch 148, each branch includes a generally horizontal segment 150 that extends outwardly from the stem, and a longer vertical segment 151. The branch surfaces are covered with a cladding formed in the same way as that used for the stem 142. In a preferred embodiment (best shown in FIG. 18), the three branches are positioned equiangularly 120° apart around stem 142 so that the vertical segments 150 of each branch form a generally equilateral triangle.

A antenna array that comprises at least one, and preferably a pair, of antennas 155 are mounted within the vertical segment 151 of each branch. Another antenna array 157 may be mounted within stem 142 itself, preferably near the top thereof. The branches may be positioned on stem 142 such that a portion of the vertical segment 151 of each branch overlaps. That arrangement allows the height of antennas 155 in each branch to be the same, although the antennas can be placed at different heights as well. It is necessary that the portion of the branches (and of stem 142) that are adjacent the antenna array be fabricated from a material that will not interfere with the transmission of radio signals to and from the antennas. For that reason it is preferred that, at least the vertical segment of branches 146, 147 and 148, and the upper portion of stem 142 be fabricated from a structural polymer such as a fiber reinforced resin.

The invention has been described in relation to preferred embodiments thereof that are illustrated in the various Figures. It must be understood that other variations of the invention will be apparent to those skilled in the art.

I claim:

1. A tower for supporting antenna, comprising:

an elongated hollow pole having a base end and a top end, said pole clad with a polymeric material that is textured and colored to simulate the bark of a palm tree;

means for fixing the base end of said pole to a foundation;

antenna mounting means near the pole top end, said antenna mounting means including an antenna bracket assembly, said assembly comprising a collar divided into multiple arcuate segments that fasten together to form a cylinder and encircle said pole, each said segment having a mount for attachment of an antenna member, the bracket assembly rotatable about the pole to thereby allow angular orientation of said antenna;

a frond bracket assembly to attach a plurality of artificial fronds to said pole, said assembly comprising a collar that fits around and clamps to said pole at a location just above said antenna bracket assembly, said collar formed as a plurality of arcuate segments that fasten together to form a cylinder and encircle said pole, each said segment having at least one fixture attached thereto for mounting a frond; and an artificial growth pod attached to said pole at a location just below said antenna bracket assembly, said growth pod having a generally hemispherical shape, open at the top, and formed from a plurality of segments that are secured to said pole at the bottoms thereof to visually shield antennas attached to said antenna bracket assembly.

2. The antenna tower of claim 1 wherein the cladding is cast from a mold taken from actual palm tree bark.

3. A tower for supporting antenna, comprising:

an elongated hollow pole having a base end and a top end, said pole clad with a polymeric material that is textured and colored to simulate the surface of a saguaro cactus stem;

means for fixing the base end of said pole to a foundation;

a plurality of branches attached to said pole stem; each of said branches including a generally horizontal segment extending outwardly from said pole stem, and a generally vertical segment; and an antenna array mounted inside the vertical segment of at least one of said branches.

4. The antenna tower of claim 3 wherein at least three branches are attached to said pole stem at different heights along said pole stem, and wherein an antenna array is mounted within each of said three branches.

5. The antenna tower of claim 4 wherein said branches are positioned such that the vertical segments of each branch form a generally equilateral triangle.

6. The antenna tower of claim 5 wherein at least a portion of each said vertical branch segment is at the same height, and wherein said antenna arrays that are mounted within said vertical segments are all at the same height.

7. The antenna tower of claim 3 including an antenna array mounted inside said pole stem at a location near the top thereof.

* * * * *